United States Patent [19]

Bastian et al.

[11] Patent Number: 4,604,931

[45] Date of Patent: Aug. 12, 1986

[54] QUICK CHANGE ROTARY PUNCH

[75] Inventors: Donald G. Bastian, Dayton; Gregory L. Slepicka, Miamisburg, both of Ohio

[73] Assignee: Harris Graphics Corporation, Melbourne, Fla.

[21] Appl. No.: 766,601

[22] Filed: Aug. 16, 1985

[51] Int. Cl.[4] ..... B26F 1/10

[52] U.S. Cl. ..... 83/665; 83/345; 83/670; 83/698; 279/76

[58] Field of Search ..... 83/345, 670, 669, 698, 83/665; 279/76, 79

[56] References Cited

U.S. PATENT DOCUMENTS

| | | | |
|---|---|---|---|
| 2,085,863 | 7/1937 | Lindbom | 83/345 |
| 3,106,859 | 10/1963 | Huffman | 83/345 |
| 3,563,124 | 2/1971 | Gargrave | 83/698 |
| 3,828,632 | 8/1974 | Grano | 83/345 |
| 4,273,015 | 6/1981 | Johnson | 83/670 |
| 4,434,690 | 3/1984 | Mauer | 83/345 X |
| 4,548,113 | 10/1985 | Topperwien et al. | 83/345 |

*Primary Examiner*—James M. Meister

*Attorney, Agent, or Firm*—Biebel, French & Nauman

[57] ABSTRACT

A quick change punch reel for a rotary press comprises a transversely split annular main body member having radially extending cylindrical sockets for receiving individual punches, each punch having a head and a base and an outer cylindrical sidewall with a circumferential undercut including a tapered wall extending toward the base of the punch. The sockets are adjacent a planar side face of the main body member and cylindrical bores are formed through the side face in alignment with and intersecting the sockets with the bores having counterbores at the side face. Punch retaining plungers are spring-biased into the bores and counterbores by means of a transversely split cap plate which is secured to the side face of the main body member. Cylindrical punches may be exchanged in the sockets by retracting the plungers against the compressive force of individual springs such that the punches are received within the sockets and retained by spherical heads of the plungers within the undercuts of the punches. Preferably, the punches are retained with their bases fully seated within the sockets by the heads of the plungers engaging the tapered sidewalls of the circumferential undercuts of the plungers to exert an axial seating force on the punches.

12 Claims, 4 Drawing Figures

QUICK CHANGE ROTARY PUNCH

BACKGROUND OF THE INVENTION

The present invention relates to rotary punches used to punch a series of holes into a web of material such as paper, paperboard or the like. Such rotary punches are used in specialized printing presses that manufacture business forms, and in which the series of holes are placed at one or both margins of continuous business forms, to be used as feed holes during further processing of the forms and/or during their use in printers, autographic registers, or the like.

With the increasing use of computers and their printers, the demand for a large variety and quantity of business forms has substantially increased in the past few years, and extensive efforts have been made to improve the efficiency of the presses and other equipment which manufacture these forms. A considerable amount of time is required to makeready business form presses, and two U.S. patents have been granted to the assignee of this application for inventions that reduce the amount of makeready time required to set up a job on such presses; these are U.S. Pat. No. 4,177,730, issued Dec. 11, 1979, and U.S. Pat. No. 4,512,256, issued Apr. 23, 1985. The ability to replace dull or broken punches in a rotary punch, and to relocate the entire punch, accurately and quickly, is important to furthering the general objective of decreased makeready time in such presses.

Rotary punches utilized in business form presses generally comprise a pair of counter-rotating reels which are positioned such that a web of material may be fed between them. One reel carries a plurality of punches which extend radially outwardly from the periphery of the reel. A plurality of dies are provided on the other reel with the dies being sized and spaced apart such that the punches register with and enter respective dies to thereby punch holes in the web of material fed between the reels.

The punches are generally made from a relatively soft steel, while the dies are made from a hardened steel such that the punches eventually wear out and must be replaced to maintain efficient operation of the rotary punch. If the punches are properly aligned with the dies, the inherent abrasiveness of the material being processed causes the punches to be worn evenly. Individual ones of the punches may become broken or damaged or may be prematurely worn if the respective punch is out of alignment with its corresponding die. Accordingly, it is desireable to be able to quickly replace one or more of the individual punches on a punch reel, and have the punch reel accurately and stably maintain the punches in proper alignment.

U.S Pat. No. 3,828,632, issued Aug. 13, 1974, discloses a rotary punch reel wherein a plurality of individual punches may be removed and replaced without disassembling the punch reel. The punch reel comprises three coaxial rings, each made up of two half rings secured together. The base ring includes a raised central hub around which the upper two rings are fitted. A series of holes are formed into the base ring to receive springs and retaining balls, and ring positioning pins upon which the upper two rings of the reel are mounted and aligned extend from the base ring. The second ring comprises a plurality of ball seats through which the spring-loaded balls project to engage and retain the individual punches. The third and final ring includes machined recesses having inclined sidewalls which define two of three points which contact and retain the punches within the machined recesses with the spring-loaded balls defining the third points of contact.

While such a rotary punch reel permits quick change of one or more of the individual punches retained within the reel, extensive machining is required to define the punch-retaining recesses, the retaining ball seats and to align the three rings forming the reel. This machining includes the precision formation of the inclined sidewalls of the recesses of the third ring of the reel, which sidewalls align the individual punches around the punch reel. Unfortunately, machining errors in the formation of the third ring are magnified by the machining errors in the alignment pins and the locating holes which receive the pins to form the reel. Accordingly, even if carefully machined, the cumulative errors produced by machining tolerances may lead to unacceptable precision and/or a limited useful life for such a rotary punch reel. It is, therefore, apparent that the need exists for a simplified construction of a punch reel for a rotary punch which is less complicated and, hence, easier and less expensive to manufacture and requires less precision machining with the construction of the punch reel being such that its assembly does not cumulate machining errors.

SUMMARY OF THE INVENTION

The machining, assembly, precision and useful life problems of the prior art punch reel are overcome by the present invention wherein the precision machining required for positioning the punches is performed on an annular main body of the punch reel. Since the machining to form punch-receiving openings is performed directly on the main body of the reel, the precision of the placement of the punches is not effected by later assembly or alignment with additional parts of the reel as in prior art punch reels.

In accordance with one aspect of the present invention, an improved quick change punch reel for use in a rotary punch comprises an annular main body member, which may be transversely split to facilitate assembly to a shaft, having radially extending cylindrical socket openings therein for receiving individual punch tools, each having a punch head at one end, a base at the other end, and an outer cylindrical sidewall, the outer cylindrical sidewall having a circumferential undercut which includes a tapered wall extending toward the base of the punch. The punch-receiving socket openings are positioned adjacent to a planar side face of the annular main body member and cylindrical bores are formed through the planar side face of the member in alignment with and intersecting the punch-receiving socket openings.

A plurality of punch-retaining plungers each comprise a first cylindrical portion which terminates in a spherical punch-retaining head at its distal end and a spring-retaining flange at its base and a second cylindrical portion extending from the base beyond the flange. The plungers are sized to be received within the bores, with their spherical punch-retaining heads extending into respective ones of the punch-receiving socket openings. Means are provided for limiting the extension of the spherical punch-retaining heads of the plungers into the socket openings. Preferably, these means comprise cylindrical counterbores of the bores at the planar side face of the main body member, with the flanges being sized such that they are received within the counterbores, but not the bores.

For the preferred embodiment, the first cylindrical portions of the plungers are sized to be received within the cylindrical bores and to extend into the respective punch-receiving openings. The flanges and the second cylindrical portions of the plungers are sized to be received within the counterbores, with the flanges engaging the shoulders between the counterbores and the bores to limit the projection of the spherical punch-retaining heads into the respective punch-receiving socket openings. The flanges also retain spring members, preferably, coil springs, which fit over the second cylindrical portions of the plungers and are also received within the counterbores.

The spring members or coil springs are longer than the counterbores such that when a cap plate, which may be transversely split to facilitate assembly to a shaft, is secured to the planar side face of the main body member, each spring member is compressed against the flange of its associated plunger and the spherical punch-retaining head of the plunger is spring-biased into its respective punch-receiving socket opening. In accordance with the present invention, the cylindrical punches may be inserted into the punch-receiving socket openings and forced to the bottoms of the openings by retracting the punch-retaining plungers against the compression springs such that the punches are received within the cylindrical socket openings and retained therein by the spring-induced pressure of the spherical punch-retaining heads of the plungers within the undercuts of the punches.

Preferably, the punches are retained with their bases fully seated within the punch-receiving socket openings by the spring-induced pressure of the spherical punch-retaining head of the plunger engaging the tapered wall of the circumferential undercut of the punch to exert an axial seating force on the punches. To maintain proper alignment of the punch reel on the rotary punch, the reel may further comprise retaining means for securing the reel to a shaft. Preferably, the retaining means comprises a split-key arrangement which not only secures the reel to the shaft, but also serves as positioning means to define a fixed rotational orientation of the reel relative to the shaft. To facilitate insertion of the punches into the punch-receiving socket openings, the punch bases are chamfered.

It is, therefore, an object of the present invention to provide an improved quick change rotary punch which requires less precision machining and is assembled such that machining errors are not cumulative; to provide an improved quick change rotary punch wherein the changeable punch elements are accurately positioned to ensure alignment with matching dies of a rotary punch; and, to provide an improved quick change rotary punch with a less complicated construction to reduce assembly time and hence manufacturing costs.

Other objects and advantages of the invention will be apparent from the following description, the accompanying drawings and the appended claims.

DETAILED DESCRIPTION OF THE INVENTION

Figure 1:
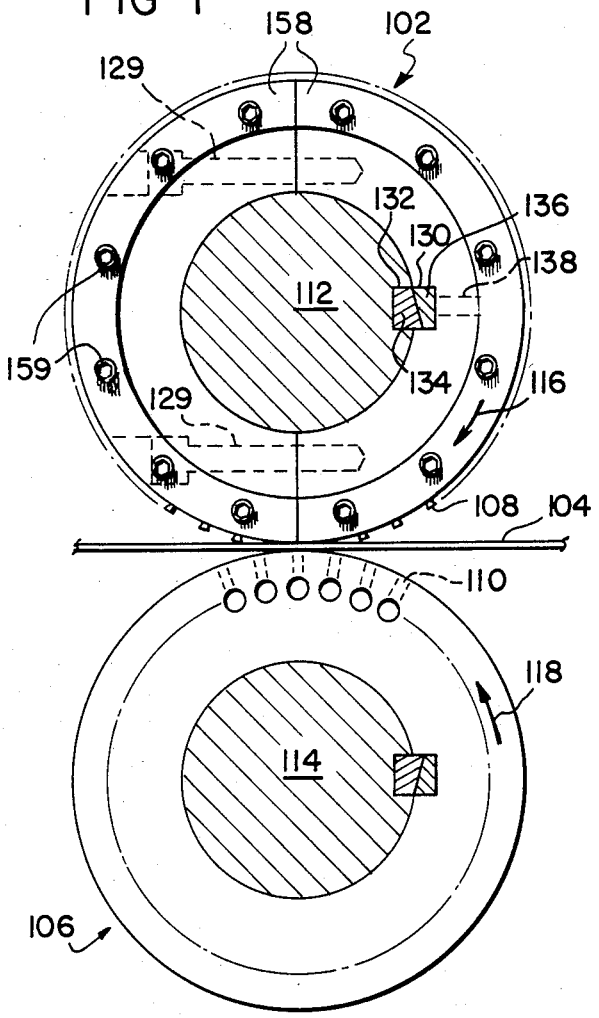
FIG. 1 is a partially sectioned side view of a rotary punch illustrating the position of a web of material passing between the punch reel of the present invention and a die reel to punch a series of holes into the web.
Figure 2:
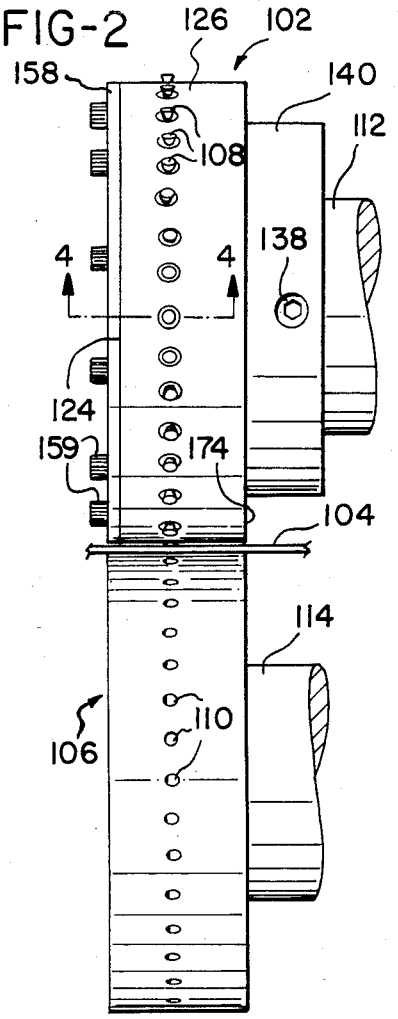
FIG. 2 is an end view of the rotary punch of FIG. 1.

FIGS. 1 and 2 illustrate a punch station in a rotary press incorporating the quick change punch reel 102 of the present invention. A web of material 104 is fed into the nip between the punch reel 102 and a die reel 106 which together comprise the punch station. The punch reel 102 supports a plurality of radially extending punch tools 108 in a removable fashion, as will be fully described herein, while the die reel 106 provides an equal number of peripheral dies 110 into which heads of the punches 108 extend for punching a series of holes into the web of material 104. The punch reel 102 and the die reel 106 are mounted for rotation on parallel shafts 112 and 114, respectively, which shafts are synchronized with one another by suitable gear elements (not shown) such that the punch reel 102 and the die reel 106 rotate simultaneously at the same peripheral speeds, but in opposite directions as indicated by arrows 116 and 118.

Figure 3:
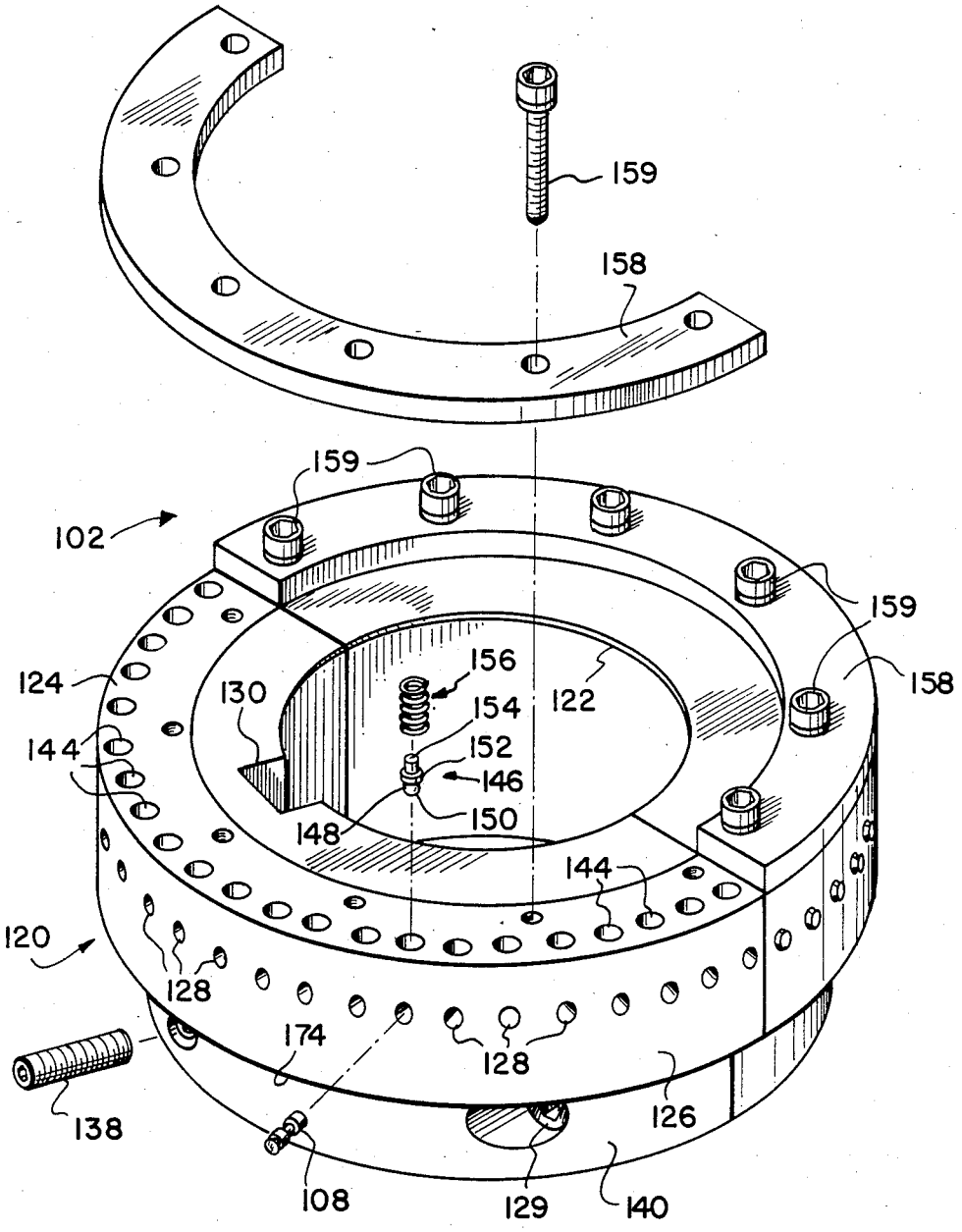
FIG. 3 is an exploded perspective view of the punch reel of the present invention.

The construction of the improved punch reel 102 in accordance with the present invention is shown more clearly in the exploded view of FIG. 3. The punch reel 102 of the preferred embodiment comprises a transversely split annular main body member 120 having a central shaft-receiving opening 122 therethrough, a planar side face 124 and an outer cylindrical surface 126. A plurality of regularly spaced radially extending cylindrical socket openings 128 are precision machined into the main body member 120 through the outer cylindrical surface 126 for receiving the individual punches 108, only one of which is shown in FIG. 3 for ease of illustration.

The annular main body member 120 is transversely split, as shown in FIGS. 1 and 3, to facilitate assembly to the shaft 112 by bolts 129; however, it will be apparent that a solid main body member can be used in the present invention. A keyway 130 is formed into the shaft-receiving opening 122 to mount the punch reel 102 to the shaft 112. A matching keyway 132 is formed into the shaft 112. To ensure that the punch reel 102 is securely fixed to the shaft 112 and properly rotationally oriented relative thereto, a split-key arrangement is utilized as shown in FIG. 1.

A first key 134 having a slanted outward facing surface is fitted into the keyway 132 of the shaft 112. A second key 136 having a matching slanted, outwardly facing surface is fitted within the keyway 130 of the annular main body member 126 such that the slanted surfaces of the keys 134 and 136 face one another and can be pressed into engagement by means of a set screw 138 which is threaded through a reduced diameter base 140 of the transversely split annular main body member 120. The keyway 130 and key 134 are typically elongated along the shaft 112 such that the punch reel 102 can be moved axially along the shaft 112 to define the processing machine. This split-key arrangement thus defines punch reel retaining means and positioning means to permit convenient movement of the reel along the shaft for rapid set-up of the rotary punch including the punch reel. By tightening the key 136 into engagement with the key 134, the punch reel 102 is quickly secured to the shaft 112 and forced to a fixed rotational orientation relative thereto.

Returning to FIG. 3, the punch-receiving socket openings 128 are precisely machined into the outer cylindrical surface 126 of the main body member 120 adjacent to the planar side face 124 of the main body member 126. Since this precision and critical machining is performed on the main body member 120 of the punch reel 102, it is not effected by the assembly of the punch reel per se, or by further machining performed on the punch reel. Accordingly, there is no cumulation of machining errors to degrade the precise locations of the punch-receiving socket openings 128. Closer machining tolerances can therefore be assured in the punch reel of the present invention such that the alignment between the punches 108 and the dies 110 can be more closely maintained to extend the useful life of the punch reel 102.

Figure 4:
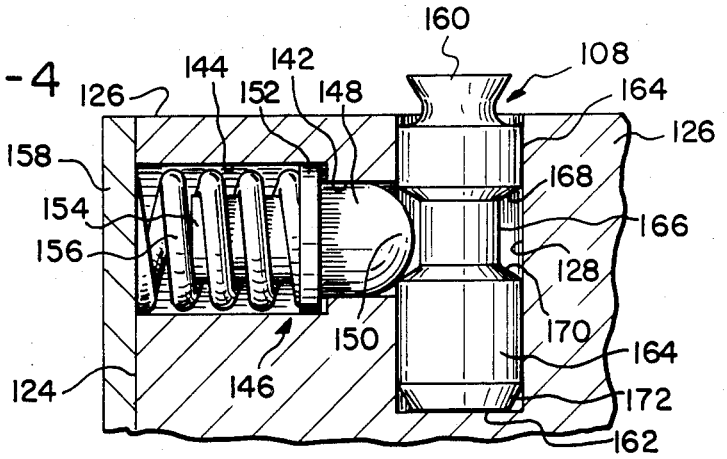
FIG. 4 is a partially sectioned view taken along section line 4—4 of FIG. 2 and showing a punch-receiving socket opening and the arrangement in accordance with the present invention for removably retaining an individual punch element within the socket opening.

A plurality of cylindrical bores 142 corresponding in number to the punch-receiving socket openings 128 are formed through the planar side face 124 of the main body member 120 and intersect the punch-receiving socket openings 128 as shown in FIG. 4. In the preferred embodiment of the present invention, each of the bores 142 has a counterbore 144 opening at the planar side face 124 of the main body member 120.

A plurality of punch-retaining plungers 146, one for each of the punch-receiving socket openings 128 are provided. Each plunger 146 comprises a first cylindrical portion 148, terminating in a spherical punch-retaining head 150 at its distal end and a spring-retaining flange 152 at its base, and a second cylindrical portion 154 extending from the base of the first cylindrical portion 148 beyond the flange 152. The first cylindrical portion 148 of each of the plungers 146 is sized to be received within one of the cylindrical bores 142 to extend into a respective one of the punch-receiving socket openings 128. The flange 152 is sized to be received within one of the counterbores 144, together with the second cylindrical portion 154 of one of the plungers 146. Only one of the plungers 146 is shown in FIG. 3 for ease of illustration.

A plurality of spring members, preferably coil springs 156, one for each of the plungers 146, are sized to receive the second cylindrical portion 154 of one of the plungers 146, and to be received within one of the counterbores 144. Only one of the springs 156 is shown in FIG. 3 for ease of illustration. An annular cap plate 158, preferably transversely split to facilitate assembly of the punch reel to a shaft, is secured to the planar side face 124 of the main body member 126 by bolts 159 to retain all of the plungers 146 and their springs 156 within respective bores 142 and counterbores 144. The springs 156 are sufficiently long that they are placed into compression between the cap plate 158 and the spring-retaining flange 152 of their associated plunger 146, such that the spherical punch-retaining head 150 of each of the plungers 146 is spring-biased into its associated punch-receiving socket opening 128. Alternate spring members, such as Bellville washers, can be used in the present invention as will be apparent to those skilled in the art.

Each of the punch tools 108 for use in the punch reel 102 of the present invention, as best shown in FIG. 4, has a punch head 160 at one end, a base 162 at the other end, and an outer cylindrical sidewall 164 having a circumferential undercut 166, which includes a tapered wall 168 extending toward the head 160 of the punch 108 and a tapered wall 170 extending toward the base 162 of the punch 108. Preferably, the base 162 includes a chamfered end 172 to facilitate insertion of the punches 108 into the punch-receiving socket openings 128 against the spring-loaded force of the spherical punch-retaining head 150 of an associated punch-retaining plunger 146.

In the preferred embodiment of the present invention, the flanges 152 together with the shoulders formed between the bores 142 and counterbores 144 form means for limiting the extension of the spherical punch-retaining heads 150 of the plungers 146 into the punch-receiving socket openings 128. This limited extension of the spherical punch-retaining heads 150 into the punch-receiving socket openings 128 facilitates insertion and removal of the punch tools 108 into the punch reel as will be apparent. It will also be apparent that alternate means can be provided for this purpose. For example, the second cylindrical portions 154 of the plungers 146 could be extended through the cap plate 158 and terminated in heads which abut the outer surface of the cap plate 158.

Operation of a rotary punch including the punch reel 102 in accordance with the present invention is apparent from the preceding description. The gear coupled shafts 112 and 114 are rotated by a suitable drive motor, and the web of material 104 which is to be serially punched is fed between the reels 102 and 106. Successive ones of the punch tools 108 punch through the web of material 104 into respective ones of the dies 110 to establish a familiar row of punched holes in the web of material 104.

If more than one row of holes is to be punched into the web 104, additional rotary punches may be secured along the shafts 112 and 114. It is apparent also that two rows of punch tools 108 can be incorporated into the punch reel 102, with the second row of punch tools 108 being positioned adjacent to a side face 174 of the main body member 120, which is opposite to the side face 124. To form the double row of punches, of course, additional punch-receiving socket openings 128 would have to be formed into the outer surface 126 of the main body member 120 together with associated bores 142 and counterbores 144. Finally, additional punch-retaining plungers 146 and springs 156 would have to be provided for the new bores 142 and counterbores 144 and an additional cap plate 158 would have to be provided and secured to the side face 174 of the main body member 120.

It will be apparent that if a punch tool 108 becomes broken or damaged, it may be pulled from its associated punch-receiving socket opening 128 by means of engaging the punch head 160 with a suitable tool, and the camming action of the tapered wall 170 of the punch tool 108 will force the plunger 146 against the compression of the associated spring 156 such that the punch tool 108 can be extracted. A new punch tool 108 can then be inserted with the chamfered end 172 serving to facilitate retraction of the plunger 146.

It will be apparent to those skilled in the art that the improved punch reel 102 of the present invention maintains the precision positioning and alignment of the punch tools in the main body member, yet permits the individual punch tools to be quickly withdrawn and replaced.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. An improved punch reel for use in a rotary punch to provide regularly spaced holes along a web of material, said punch reel being adapted to receive and accurately retain punch tools, each having a punch head at one end, a base at the other end, and an outer cylindrical sidewall, the outer cylindrical sidewall having a circumferential undercut which includes a tapered wall extending toward the base of said punch, said reel comprising:

an annular main body member having a central shaft-receiving opening therethrough, a planar side face, and an outer cylindrical surface having a plurality of regularly spaced radially extending cylindrical socket openings therein for receiving the individual punches, said punch-receiving socket openings being adjacent to said planar side face of said main body member;

a corresponding plurality of cylindrical bores extending through said planar side face and intersecting said punch-receiving socket openings;

a plurality of punch-retaining plungers, one for each of said punch-receiving socket openings, each of said plungers having a first cylindrical portion terminating in a spherical punch-retaining head at its distal end and a spring-retaining flange at its base, and a second cylindrical portion extending from the base of said first cylindrical portion beyond said flange, said punches being sized to be received within one of said cylindrical bores with said spherical punch-retaining head of said first cylindrical portion extending into a respective one of said punch-receiving socket openings;

means for limiting the extension of said spherical punch-retaining heads of said plungers into said punch-receiving socket openings;

a plurality of spring members, one for each of said plungers, each of said spring members being sized to receive said second cylindrical portion of one of said plungers and to be received within one of said bores; and a cap plate secured to the planar side face of said main body member to retain all of said plungers and said springs in said respective bores, said springs being sized such that they are placed into compression between said cap plate and said spring-retaining flange whereby each punch may be quickly changed yet, once inserted, is retained within one of said punch-receiving socket openings by the spring-induced pressure of the spherical punch-retaining head of said plunger within the circumferential undercut of the punch.

2. An improved punch reel for use in a rotary punch as claimed in claim 1 wherein the punch is retained with its base fully seated in one of said punch-receiving socket openings by the spring-induced pressure of the spherical punch-retaining head of said plunger engaging the tapered wall of the circumferential undercut of the punch to exert an axial seating force on the punch.

3. An improved punch reel for use in a rotary punch as claimed in claim 2 wherein said annular main body member and said cap plate are transversely split to facilitate assembly of said punch reel to a shaft.

4. An improved punch reel for use in a rotary punch as claimed in claim 3 wherein said spring members comprise coil springs.

5. An improved punch reel for use in a rotary punch to provide regularly spaced holes along a web of material, said punch reel being adapted to receive and accurately retain punch tools, each having a punch head at one end, a base at the other end, and an outer cylindrical sidewall, the outer cylindrical sidewall having a circumferential undercut which includes a tapered wall extending toward the base of said punch, said reel comprising:

an annular main body member having a central shaft-receiving opening therethrough, a planar side face, and an outer cylindrical surface having a plurality of regularly spaced radially extending cylindrical socket openings therein for receiving the individual punches, said punch-receiving socket openings being adjacent to said planar side face of said main body member;

a corresponding plurality of cylindrical bores extending through said planar side face and intersecting said punch-receiving socket openings, each of said bores having a counterbore at said planar side face;

a plurality of punch-retaining plungers, one for each of said punch-receiving socket openings, each of said plungers having a first cylindrical portion terminating in a spherical punch-retaining head at its distal end and a spring-retaining flange at its base, and a second cylindrical portion extending from the base of said first cylindrical portion beyond said flange, said first cylindrical portion being sized to be received within one of said cylindrical bores to extend into a respective one of said punch-receiving socket openings, said flange being sized to be received within said counterbore;

a plurality of spring members, one for each of said plungers, each of said spring members being sized to receive said second cylindrical portion of one of said plungers and to be received within one of said counterbores; and a cap plate secured to the planar side face of said main body member to retain all of said plungers and said springs in said respective bores and counterbores, said springs being sized such that they are placed into compression between said cap plate and said spring-retaining flange whereby each punch may be quickly changed yet, once inserted, is retained within one of said punch-receiving socket openings by the spring-induced pressure of the spherical punch-retaining head of said plunger within the circumferential undercut of the punch.

6. An improved punch reel for use in a rotary punch as claimed in claim 5 wherein the punch is retained with its base fully seated in one of said punch-receiving socket openings by the spring-induced pressure of the spherical punch-retaining head of said plunger engaging the tapered wall of the circumferential undercut of the punch to exert an axial seating force on the punch.

7. An improved punch reel for use in a rotary punch as claimed in claim 6 wherein said annular main body member and said cap plate are transversely split to facilitate assembly of said punch reel to a shaft.

8. An improved punch reel for use in a rotary punch as claimed in claim 7 wherein said spring members comprise coil springs.

9. An improved punch reel for use in a rotary punch as claimed in claim 8 and further comprising retaining means for securing said reel to a shaft.

10. An improved punch reel for use in a rotary punch as claimed in claim 9 wherein said retaining means further comprises positioning means for securing said punch reel to a shaft in a fixed rotational orientation relative to the shaft.

11. An improved punch reel for use in a rotary punch as claimed in claim 10 wherein said positioning means comprises a split-key.

12. An improved punch reel for use in a rotary punch as claimed in claim 11 further comprising a plurality of punch tools, one for each of said punch-receiving socket openings wherein the bases of said plurality of punches are chamfered to facilitate insertion of said bases beyond said punch-retaining plungers.

* * * * *